US006279449B1

(12) United States Patent
Ladika et al.

(10) Patent No.: US 6,279,449 B1
(45) Date of Patent: Aug. 28, 2001

(54) RAPID DEPLOYMENT COUNTERMEASURE SYSTEM AND METHOD

(75) Inventors: Michael D. Ladika, Fair Oaks Ranch; Geoffrey Dearnaley, San Antonio, both of TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 09/435,556

(22) Filed: Nov. 8, 1999

(51) Int. Cl.[7] ..... F41H 5/007
(52) U.S. Cl. ..... 89/36.17; 89/36.02
(58) Field of Search ..... 89/36.17, 36.02; 280/735, 736; 109/49.5

(56) References Cited

U.S. PATENT DOCUMENTS

| | | | |
|---|---|---|---|
| 3,684,309 | 8/1972 | Uchiyamada et al. . | |
| 3,687,213 | 8/1972 | Sato et al. . | |
| 3,703,702 | 11/1972 | Arai . | |
| 3,778,823 | 12/1973 | Sato et al. . | |
| 3,861,710 | 1/1975 | Okubo . | |
| 3,893,368 | 7/1975 | Wales, Jr. . | |
| 4,782,735 | 11/1988 | Mui et al. . | |
| 4,856,436 | 8/1989 | Campbell . | |
| 5,012,742 | 5/1991 | Jones . | |
| 5,327,811 | 7/1994 | Price et al. . | |
| 5,370,035 | 12/1994 | Madden, Jr. . | |
| 5,392,686 | 2/1995 | Sankar . | |
| 5,398,185 | 3/1995 | Omura . | |
| 5,435,226 | 7/1995 | McQuilkin . | |
| 5,451,381 | 9/1995 | Kishimoto et al. . | |
| 5,478,109 | 12/1995 | Faigle et al. . | |
| 5,483,449 | 1/1996 | Caruso et al. . | |
| 5,540,461 | 7/1996 | Nitschke et al. . | |
| 5,578,784 | 11/1996 | Karr et al. . | |
| 5,584,507 | 12/1996 | Khandhadia et al. . | |
| 5,646,613 | 7/1997 | Cho . | |
| 5,739,458 * | 4/1998 | Girard | 89/36.02 |
| 5,790,404 | 8/1998 | Fay et al. . | |
| 5,792,976 | 8/1998 | Genovese . | |
| 6,029,558 * | 2/2000 | Stevens et al. | 89/36.17 |
| 6,128,999 * | 10/2000 | Sepp et al. | 89/36.17 |

FOREIGN PATENT DOCUMENTS

| | | | |
|---|---|---|---|
| 3804991C1 * | 7/1999 | (DE) . | |
| 1508728 * | 4/1978 | (GB) . | |
| 2200437 | 8/1988 | (GB) . | |
| 2234334 * | 1/1991 | (GB) | 89/36.17 |

OTHER PUBLICATIONS

Intenational Search Report, PCT/US00/29207, Mar. 22, 2001.*

* cited by examiner

*Primary Examiner*—Stephen M. Johnson
(74) *Attorney, Agent, or Firm*—Baker Botts L.L.P.

(57) ABSTRACT

A rapid deployment countermeasure system comprises a base attached to a plurality of tubes which are in fluid communication with at least one deployment module. A guidance bar is attached to the top ends of the tubes, and a guidance shroud is proximate to the outer surfaces of the tubes. The system includes one or more anti-ballistic blankets fixedly attached to the guidance bar, and is erected to form an anti-ballistic barrier upon activation of the deployment modules. A method to reactively protect personnel from the approach of a ballistic projectile by deployment of a countermeasure system prior to arrival of the projectile at the location of the personnel comprises the steps of detecting the approach of the ballistic projectile, discriminating the presence of the ballistic projectile with respect to other moving objects or electronic noise, and activating the countermeasure system in response to discriminating the presence of the ballistic projectile so as to interpose an anti-ballistic barrier between the personnel and the projectile.

22 Claims, 2 Drawing Sheets

RAPID DEPLOYMENT COUNTERMEASURE SYSTEM AND METHOD

CROSS-REFERENCE TO RELATED APPLICATION

Reference is made to U.S. patent application Ser. No. 08/855,895 filed on May 12, 1997, now U.S. Pat. No. 6,029,558 entitled "Reactive Personnel Protection System (As Amended)" by David J. Stevens et al.

BACKGROUND OF THE INVENTION

1. Technical Field

This invention relates generally to the field of apparatus and methods for shielding the body from hostile activity, such as ballistic projectiles generated by snipers. More particularly, this invention relates to an apparatus and method capable of shielding personnel from ballistic projectiles by interposing an anti-ballistic shield between a ballistic projectile and the person to whom it is directed.

2. History of Related Art

Many different approaches to the protection of personnel from life-threatening attacks exist. Examples of such approaches include bullet-proof glass, concrete and steel building structures, armored cars, bullet-proof jackets, and others. The effectiveness of any particular method depends on whether the personnel target is stationary, located in a vehicle, within a building, or outside the confines of any particular protective structure.

Law enforcement agencies are often tasked to protect public figures from terroristic attacks. Typically, such protection is achieved through a combination of passive armoring (e.g., bullet-proof vests and other apparel), identification and control of potential sniper vantage points, and other types of passive protection, such as shields, armor plates, and other devices. However, most public figures desire unrestricted access to the public and traditional ballistic screens are not in accord with the high visibility desired. Such countermeasures must be placed in close proximity to the targeted personnel to be effective, and this may impede the access desired.

One approach to solving this problem involves the erection of a bullet-proof, or anti-ballistic airbag between the personnel target and the ballistic projectile as soon as is practical after the projectile has been detected. However, this approach may fail with respect to the speed of barrier erection required, because an airbag structure requires large volumes of gas to inflate. Supplying the large amount of gas/fluid volume needed in the short amount of time allowed is often not possible. Further, the erection of a simple airbag structure may not occur in precisely the intended direction due to inequalities in packing, gas deployment pressures, and other physical limitations.

Therefore, a need exists for an unobtrusive, reactive device that provides adequate ballistic protection for targeted personnel with respect to ballistic projectiles. Further, the need exists for a countermeasure system which can be erected quickly, and in a particular direction, on a consistent basis. The system should provide for erection of an anti-ballistic barrier which is of variable size, and also provide a means for the accommodation of partial failures within the system.

The need also exists for a method to actively protect personnel from the approach of a ballistic object by deploying a countermeasure system such that a ballistic object can be detected, discriminated in the presence of other moving objects, and the system put into place before the projectile can reach the target personnel. The method should also provide varying degrees of protection with respect to the size and speed of projectiles expected, and the possible detection of multiple projectiles emanating from different geographic locations.

SUMMARY OF THE INVENTION

The rapid deployment countermeasure system of the present invention comprises a base to which is attached a plurality of tubes. Each of the tubes is in fluid communication with one or more deployment modules, which may comprise gas or hybrid generators such that activation of the generators fills the tubes with gas and inflates them to some predetermined height. Several tubes may be connected to a single deployment module using a manifold, or in the alternative, each tube may be connected to a single deployment module. Instead of being attached to the base, each tube may be attached directly to a manifold or deployment module, which is in turn affixed to the base.

A guidance shroud is laid over the tubes, in close proximity to them, and also affixed to the base. The shroud may be divided up into cells such that each tube is contained within an individual cell. A guidance bar is attached to the top of each tube through the shroud, and also to one or two (or more) anti-ballistic blankets. The countermeasure system is deployed upon sensing the approach of a ballistic projectile, typically using a radar-based detection system.

The method to reactively protect personnel from the approach of a ballistic object by deploying the countermeasure system prior to arrival of the object at the location of the personnel comprises the steps of detecting the approach of the ballistic object using a detection system (e.g. radar or infra-red based), discriminating the presence of the ballistic object with respect to other objects in the vicinity and electronic noise, and activating the countermeasure system in response to discriminating the presence of a ballistic object.

The system and method of the present invention are capable of erecting an anti-ballistic barrier capable of protecting target personnel within 100 milliseconds (msecs) or less of detecting the approach of a ballistic projectile. Depending on the number of deployment modules and tubes in use, along with the speed of inflation, the countermeasure system may even be erected in less than 50 msecs. This amount of time is sufficient to provide a protection radius of approximately 50 ft. around the target when a 9 millimeter bullet is used as the ballistic projectile. The erection speed of the system may be further increased by using a launch mass, or impact mass in conjunction with the deployment module, to physically impact the guidance bar upon activation of the deployment module, causing a much faster deployment of the tubes within the shroud.

The tubes may be constructed as a unitary assembly, as a series of telescoping elements, or as a combination of tubes, including a gas bladder tube surrounded by a reinforcing tube. The reinforcing tube provides hoop reinforcement and a means of mechanical attachment. The tubes may be constructed from rubber-coated fabric or silicone-coated nylon fabric. The tubes may also be vented to control the standing time of the system after deployment. Standing times are typically on the order of hours or minutes, but can be reduced by using a venting means.

The protective blankets may be constructed from one or more layers of anti-ballistic material, such as aramid fabric or woven or layered polyethylene. The first blanket (impacted by the ballistic projectile before any other blankets) may be constructed such that it contains significantly more layers than secondary or subsequent blankets in order to protect the integrity of the tubular supports within the shroud from the destructive effects of multiple ballistic projectiles.

BRIEF DESCRIPTION OF THE DRAWINGS

A more complete understanding of the structure and operation of the present invention may be had by reference to the following detailed description taken in conjunction with the accompanying drawings, wherein.

DETAILED DESCRIPTION OF PRESENTLY PREFERRED EXEMPLARY EMBODIMENTS

Figure 1A:
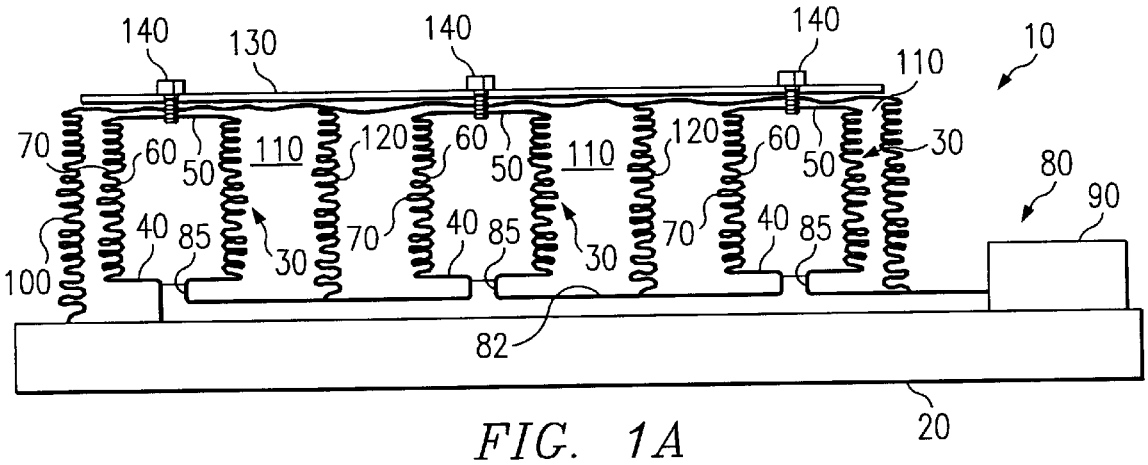
FIGS. 1A and 1B are frontal, cut-away, views of the rapid deployment countermeasure system of the present invention, prior to deployment, and after deployment, respectively.
Figure 1B:
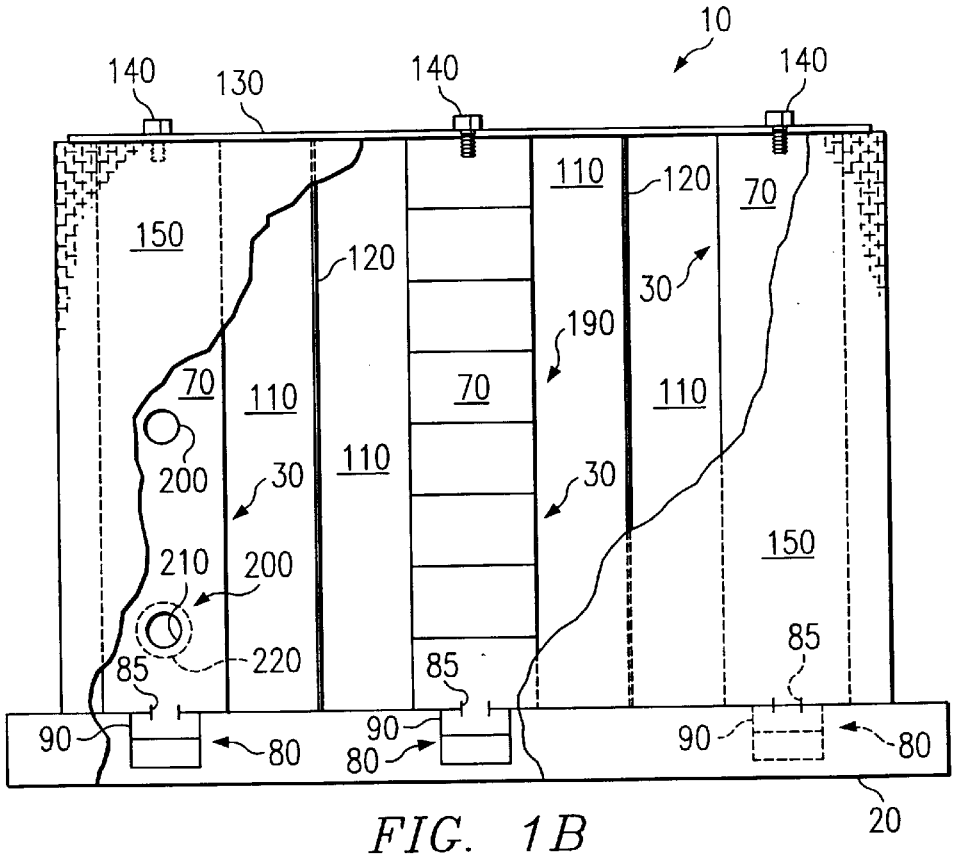

The present invention, a rapid deployment countermeasure system, is illustrated prior to deployment in FIG. 1A. The system 10 comprises a base 20 to which one or more deployment modules 80 are attached. A plurality of tubes 30 can be attached to the deployment module 80, which is in turn affixed to the base 20, as shown in FIG. 1A. Alternatively, the tubes 30 may be affixed directly to the base 20, as shown in FIG. 1B. In either case, each one of the tubes 30 has a bottom end 40, a top end 50, an inner surface 60, and an outer surface 70. The deployment module 80 is in fluid communication with the inner surfaces 60 of the tubes 30. As illustrated in FIG. 1A, this communication is accomplished by using a manifold 82.

A shroud 100, proximate to the outer surfaces 70 of the tubes 30 is used to guide the tubes 30 from their position before deployment (as shown in FIG. 1A) to the fully erected position after deployment (shown in FIG. 1B). A guidance bar 130 is attached to the top ends 50 of the tubes 30, and typically, to the guidance shroud 100. When using two or more deployment modules 80, the guidance bar 130 helps to control the direction of the tubes 30 during the erection process. Further, the guidance bar 130 helps to maintain a rectangular configuration of the system 10 after deployment. Attachment may be by any of several means, including bolts 140, rivets, adhesive, hook-and-loop fasteners, or other suitable means which can provide at least about 10 grams per square mm of peel strength.

The guidance shroud 100 is typically divided into several cells 110, such that each tube 30 is isolated within its own cell 110. As the tubes 30 extend, there is a tendency to buckle, reducing the ability to rapidly and effectively erect the system 10. The guidance shroud 100 prevents the tubes 30 from buckling during erection of the system 10. Thus, upon erection, the tubes 30 tend to expand in a direction determined by the cell 110 geometry, and interference between tubes 30 during the erection process is minimized or eliminated.

The tubes 30 may be constructed from rubber-coated fabric, silicone-coated nylon fabric, or other materials which are commonly used to construct life rafts, recreational inflatable vehicles, automotive air bags and other devices well known in the art. For the most effective operation of the system 10, it is preferred that the coefficient of friction between the tubes 30 and the shroud 100 is minimized.

The system 10 is erected by providing an activation signal to the deployment module 80, which typically comprises a gas generator 90. Such gas generators are well known in the art of airbag protection systems available in automobiles. The deployment module 80 may use a solid propellant, a compressed gas, or a liquid coolant to provide the rapid volumetric expansion of the tubes 30 that is required for effective operation of the system 10. Typical gas generators 90 include those made by Breed Technologies P/N 99807840, and Pacific Scientific experimental models.

The system 10 is erected upon detection of a ballistic projectile by providing an activation signal to the deployment module 80. If a gas generator 90 is used as part of the deployment module 80, then gas is rapidly generated and, as illustrated in FIG. 1A, sent along a manifold 82 into each tube 30 by way of inflation ports 85. The gas produced by the gas generator 90 expands the tubes 30 so as to raise the guidance bar 130 from a pre-deployment position (shown in FIG. 1A), to a deployed position (shown in FIG. 1B). As can be seen in FIG. 1B, the tubes 30 are fully inflated so as to reach their maximum extensible height.

Not shown in FIG. 1A, but illustrated in FIG. 1B, is the first anti-ballistic blanket 150. This blanket 150 is attached to the guidance bar 130, typically by means of bolts 140. The blanket 150 may be constructed from aramid fabric, woven polyethylene, ballistic nylon and fabrics made from poly (p-phenylene-2, 6-bezobisoxazole) fibers. While the system 10 can be operated from a single deployment module 80, as shown in FIG. 1A, separate deployment modules 80 can also be used as shown in FIG. 1B. In this illustration, each tube 30 is in fluid communication with a separate deployment module 80, and gas generator 90. Upon application of an activation signal, the gas generators 90 serve to inflate the tubes 30 in a rapid fashion. The advantage of using a plurality of tubes in a one-to-one correspondence with a plurality of deployment modules 80 resides in the redundant capability of raising the guidance bar 130, and therefore the blanket 150, even in the face of one or more of the deployment modules 80 failing to activate.

Other features of the invention are also illustrated in FIG. 1B. For example, the tubes 30 may comprise a telescoping assembly 190. The erection of the telescoping assembly 190 is similar to that in effect for automobile radio antennas which are raised and lowered using air pressure, and well known in the art. The telescoping assembly 190 can be made to lock in place so that the system 10 remains erected after activation. Another variation includes the use of one or more venting means 200 to control the standing time of the system 10. The venting means 200 is in fluid communication with the inner surface 60 of the tube 30 in which it is installed. That is, once the tubes 30 are inflated, it may be desirable to deactivate the system 10 after a predetermined amount of time. A venting means 200, comprising a vent aperture 210 and a flap 220 allows the controlled escape of gas from the inner surface 60 of the tube 30 to the atmosphere. As illustrated in FIG. 1B, the venting means 200 may comprise a simple hole, or more sophisticated gas venting mechanisms, such as solenoid controlled (pneumatic or electric) valves, manual valves (i.e., ball valves, gate valves), and other types which are all commercially available from a number of different manufacturers.

Figure 2:
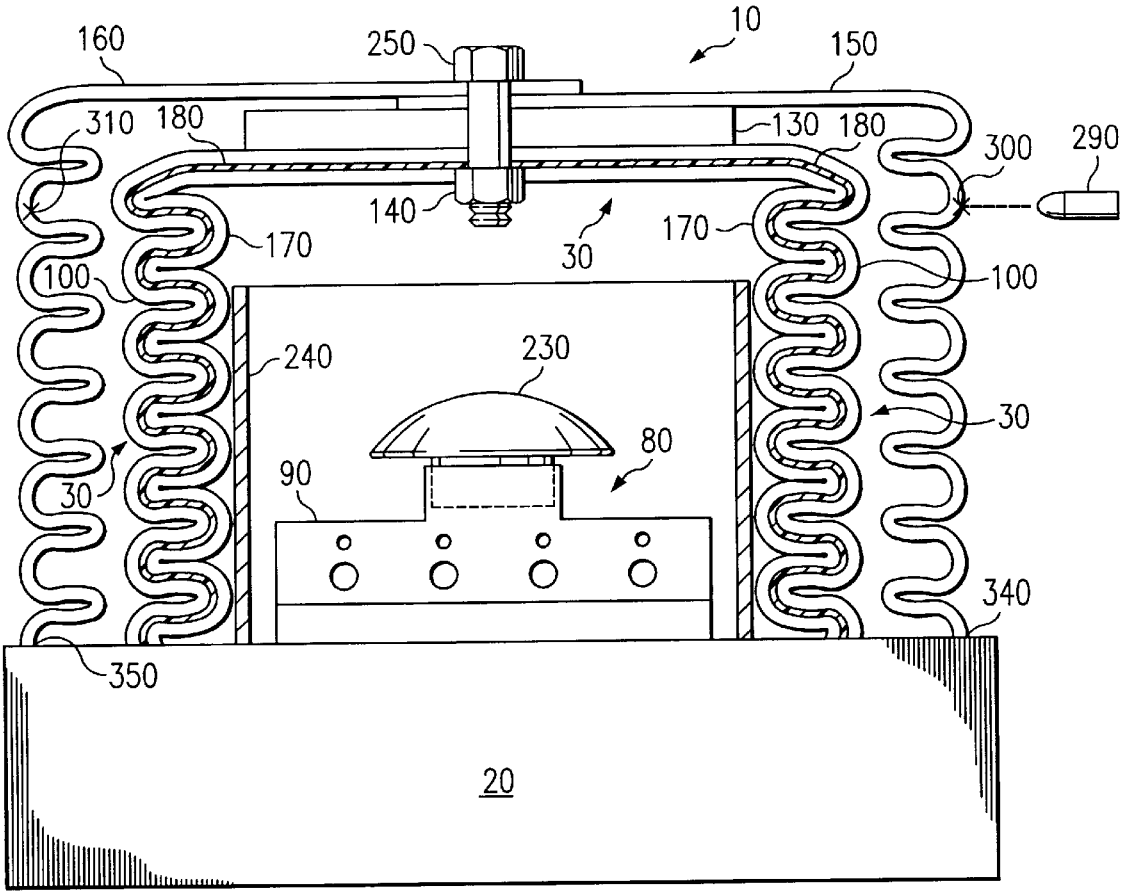
FIG. 2 is a side, cut-away, pre-deployment view of the rapid deployment countermeasure system of the present invention.

FIG. 2 illustrates an alternative embodiment of the system 10 of the present invention. Shown here is a system wherein the tube 30 comprises a gas bladder 170 and a reinforcing tube 180. It is often useful to construct a tube 30 of complementary materials to ensure adequate retention of gas generated by the deployment module 80 with respect to fluid impermeability, along with sufficient strength to retain the gas at the pressures experienced at the time full deployment is achieved. As noted in FIG. 1A, a single or first blanket 150 may be attached to the guidance bar 130. However, a second blanket 160 may also be attached to the guidance bar to provide additional protection for targeted personnel. Alternatively, a single blanket 150 may be attached to the guidance bar 130, extending from one side of the tubes 30, over the guidance bar 130, and on to the other side of the tubes 30. That is, the first blanket 150 may be attached to the base 20 at two different points, the first attachment point 340 and second attachment point 350. Alternatively, the first blanket 150 may be attached to the base 20 at first attachment point 340, and the second blanket 160 may be attached to the base 20 at the second attachment point 350. The first and second blankets 150 and 160 in this instance are both attached to the guidance bar 130 by means of the bolt 140 and the nut 250, or other appropriate fastening means, as noted previously.

The guidance shroud 100 is important to properly directing the tubes 30 as they travel in a vertical direction during the erection process. Dividing the shroud into cells 110 helps to further isolate individual tubes 30 and ensure travel in the desired direction. Another means of directing the vertical travel of the tubes 30 is to make use of a packing sleeve 240 (i.e., a shorter version of the guidance shroud 100) which extends upwardly away from the base 20 for at least about 5% of the length of the individual tube 30.

Testing has shown that, when a first and second blanket 150 and 160 are used, the system 10 can be made to erect a barrier which achieves a height of two meters within about 50 msecs of detecting the approach of a ballistic projectile. Increasing the speed of erection can be accomplished using several approaches. The first is to decrease the diameter of the tubes 30, or the height of the tubes 30 so as to decrease the needed volume of gas for complete inflation. The second is to increase the speed of ballistic projectile detection. The third is to use the lightest materials possible for the tubes 30, the shroud 100, the blankets 150,160, and the guidance bar 130. Fourth, the speed at which the deployment module 80 operates can be increased, and the volume of gas generated per unit time may also be increased. Finally, a launch mass 230 may be inserted into the deployment module 80 and driven upward with ballistic velocity toward the guidance bar 130 upon activation of the deployment module 80 by the gas generator 90. The physical impact of the launch mass 230 against the guidance bar 130 serves to create a semi-vacuum against the tube inner surface 60, which is rapidly filled by the produced by the gas generator 90. Also, the height of the guidance bar 130 is raised more rapidly than would be possible using the generation of gas alone.

Figure 3:
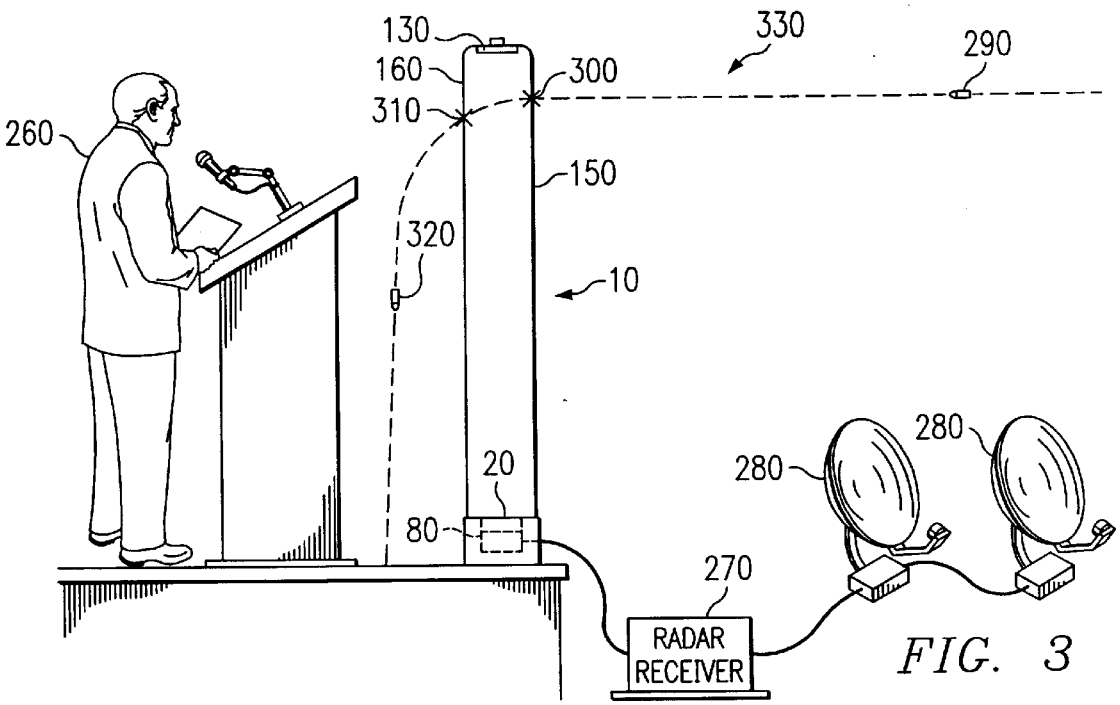
FIG. 3 illustrates the method of the present invention with respect to reactive protection of personnel targeted by a ballistic projectile.

Turning now to FIG. 3, the method of the present invention can be seen. A method to reactively protect personnel 260 from the approach of a ballistic projectile 290 by deployment of a countermeasure system 10 prior to arrival of the projectile 290 at the location of the personnel 260 comprises the steps of detecting the approach of the ballistic projectile 290 in proximity to the personnel 260, discriminating the presence of the ballistic projectile 290 in the presence of other moving objects or electronic noise, and activating the countermeasure system 10 in response to discriminating the presence of the ballistic projectile 290. For the purposes of describing the present invention, a "ballistic projectile" is one that moves at a speed of greater than about 50 meters per second.

As can be seen in FIG. 3, the ballistic projectile 290 proceeds along a flight path 330 until it impacts the first blanket 150 at the first impact point 300. The ballistic projectile 290 continues along a still further modified flight path 330 until it impacts the second blanket 160 at the second impact point 310, and continues along the flight path 330 as a deflected projectile 320. At this point in time, the ballistic projectile 290 has very little, if any, residual kinetic energy. Of course, the system can also be designed such that the ballistic projectile 290 is stopped on the first blanket.

As can be seen from FIG. 3, the first blanket 150 may be attached directly to the base 20, or merely attached to the guidance bar 130, without being attached to the base 20. Similarly, the second blanket 160 may also be attached directly to the base 20, or, as illustrated, left to hang apart from the base 20. In either case, the first and second blankets 150, 160 are fixedly attached to the guidance bar 130 and maintained in a spaced apart relationship. The guidance bar may be attached to the very top of the system 10, above the first blanket 150, the shroud 100, and the tubes 30. Also, the guidance bar may be attached to the tops of the tubes 30, and underneath the shroud 100 and the first blanket 150. The guidance bar 130 may also be attached on top of the shroud 100 and underneath the first blanket 150. For increased effectiveness, the first blanket 150 may comprise more than one layer of fabric. Similarly, the second blanket 160 may also comprise more than one layer of fabric. It may be desirable to fabricate the first blanket 150 such that it comprises many more layers than the second blanket 160. This helps to provide the greatest reduction in the kinetic energy of the ballistic projectile 290 as it impacts the first blanket 150. Not only does this reduce the level of protection required by the second blanket 160, it also serves to protect the tubes 30 residing in the space between the two blankets 150, 160.

Detecting the approach of the ballistic projectile in proximity to the personnel 260 is typically accomplished with an antenna 280 connected to a radar receiver 270. A Doppler radar system is typically the most effective mechanism for detecting the presence of a ballistic projectile in a short time. Detection times are typically on the order of 2 or 3 msecs. Such detection systems are well known in the art. A suitable system includes the Weibel W-700 family of Doppler radar systems.

One of the advantages of the instant invention is the ability to provide an anti-ballistic barrier of practically any size. That is, while the height of the barrier may be limited somewhat by the weight and volume of the materials used to construct the system 10, the length of the system 10 can be extended indefinitely by increasing the number of tubes 30 and deployment modules 80, as required. Further, increased erection speed can be achieved by the use of multiple launch masses 230, as described above. Finally, the use of a plurality of tubes 30 within the system 10 provides redundancy during the erection process in the case of a failure by one or more of the tubes and/or deployment modules 80 to inflate properly. Also, even if some of the tubes 30 are destroyed by the use of multiple ballistic projectiles directed at the system 10, it is unlikely that a significant number of the tubes 30 will be disabled such that the system 10 is completely ineffective. A complete failure of the system 10 is only possible if a significant number of the tubes 30 are targeted, and, since the precise position of the tubes 30 is hidden behind the first blanket 150, this is unlikely.

While a Doppler radar system can be used to effectively detect the approach of a ballistic projectile, discriminating the presence of the projectile with respect to other moving objects or electronic noise typically requires the use of tone decoders which are set to detect specific frequency ranges. Several decoders can be used in concert to build a frequency signature for ballistic event detection. This process is well known in the art. Systems for detection and discrimination of ballistic projectiles are available from Weibel Scientific, in Denmark. Another alternative to radar-based detection systems is the use of infrared technology. Such an approach is typically impractical for short distances because of the massive computer processing power required and the slow framing rate of infrared cameras. However, the infrared detection approach may work well as an adjunct to radar-based detection at extended ranges. Use of multiple sensor types also helps to prevent false alarms and provide better discrimination capability.

Although the present invention is described in terms of preferred exemplary embodiments, other uses of the invention are contemplated. Such uses are intended to fall within the scope of the following claims.

What is claimed is:

1. A rapid deployment countermeasure system comprising:

a base;

a plurality of tubes, each one of the said plurality of tubes having a bottom end, a top end, an inner surface, and an outer surface, each one of the bottom ends of the plurality of tubes being fixedly attached to the base;

at least one deployment module in fluid communication with each one of the inner surfaces of the plurality of tubes;

a guidance bar attached to each one of the top ends of the plurality of tubes;

a guidance shroud proximate to each one of the outer surfaces of the plurality of tubes; and a first blanket fixedly attached to the guidance bar.

2. The system of claim 1, wherein the first blanket is constructed from antiballistic polyethylene material.

3. The system of claim 1, wherein the first blanket is constructed from aramid fabric.

4. The system of claim 1, wherein the first blanket is constructed from poly fabric.

5. The system of claim 1, wherein the first blanket is constructed from ballistic nylon.

6. The system of claim 1, wherein the at least one deployment module includes a gas-generating system.

7. The system of claim 1, wherein the first blanket is fixedly attached to the base.

8. The system of claim 1, wherein at least one of the plurality of tubes comprises rubber-coated fabric.

9. The system of claim 1, wherein at least one of the plurality of tubes comprises silicone-coated nylon fabric.

10. The system of claim 1, wherein at least one of the plurality of tubes comprises a gas bladder tube located within a reinforcing tube.

11. The system of claim 1, wherein at least one of the plurality of tubes comprises a telescoping assembly.

12. The system of claim 1, wherein the standing time of the plurality of tubes is controlled by a venting means in fluid communication with the inner surfaces of the plurality of tubes.

13. The system of claim 1, wherein the guidance shroud further comprises a plurality of guidance cells.

14. The system of claim 1, wherein the first blanket comprises a plurality of fabric layers.

15. The system of claim 1, comprising a second blanket fixedly attached to the guidance bar and maintained in a spaced apart relationship from the first blanket.

16. The system of claim 15, wherein the first blanket comprises a first plurality of layers, the second blanket comprises a second plurality of layers, and the number of the second plurality of layers is greater than the number of the first plurality of layers.

17. The system of claim 1, comprising a plurality of deployment modules, wherein each one of the plurality of tubes is in fluid communication with at least one of the plurality of deployment modules.

18. The system of claim 1, wherein the deployment module comprises a launch mass.

19. A method to reactively protect personnel from the approach of a ballistic projectile by deployment of a countermeasure system prior to the arrival of the projectile at the location of said personnel, comprising the steps of:

detecting the approach of said ballistic projectile in proximity to said personnel;

discriminating the presence of said ballistic projectile with respect to the presence of electronic noise; and activating a countermeasure system in response to discriminating the presence of the ballistic projectile, the countermeasure system comprising a base, a plurality of tubes fixedly attached to the base, a deployment module in fluid communication with the plurality of tubes, a guidance bar attached to the plurality of tubes, a guidance shroud proximate to the plurality of tubes, and a first blanket fixedly attached to the guidance bar.

20. The method of claim 19, wherein said detecting step is accomplished using a radar-based projectile detection system.

21. The method of claim 19, wherein the countermeasure system comprises a second blanket fixedly attached to the guidance bar and maintained in a spaced apart relationship with the first blanket.

22. The method of claim 19, wherein the first blanket comprises a first plurality of layers, the second blanket comprises a second plurality of layers, and the number of the second plurality is greater than the number of the first plurality.

* * * * *